US008974354B1

(12) United States Patent
Nelson et al.

(10) Patent No.: US 8,974,354 B1
(45) Date of Patent: Mar. 10, 2015

(54) LANDMINE APPARATUSES

(75) Inventors: Westin Nelson, Dayton, MN (US); Dennis Whaley, Otsego, MN (US)

(73) Assignee: Brunswick Corporation, Lake Forest, IL (US)

( * ) Notice: Subject to any disclaimer, the term of this patent is extended or adjusted under 35 U.S.C. 154(b) by 362 days.

(21) Appl. No.: 13/427,569

(22) Filed: Mar. 22, 2012

Related U.S. Application Data

(60) Provisional application No. 61/583,086, filed on Jan. 4, 2012.

(51) Int. Cl.
*A63B 21/06* (2006.01)

(52) U.S. Cl.
USPC ..... 482/94

(58) Field of Classification Search
USPC ..... 482/92, 94, 112, 115, 117; 434/247
See application file for complete search history.

(56) References Cited

U.S. PATENT DOCUMENTS

| | | | | |
|---|---|---|---|---|
| 605,747 | A | 6/1898 | Sachs et al. | |
| 1,535,391 | A * | 4/1925 | Anderson | 482/117 |
| 1,973,593 | A | 9/1934 | Willner | |
| 3,802,701 | A * | 4/1974 | Good, Jr. | 482/119 |
| 3,957,266 | A * | 5/1976 | Rice | 482/91 |
| 4,249,727 | A | 2/1981 | Dehan | |
| 5,013,034 | A * | 5/1991 | March et al. | 482/115 |
| 5,207,624 | A | 5/1993 | Paskovich | |
| 5,244,444 | A | 9/1993 | Wostry | |
| 5,487,712 | A | 1/1996 | Kann | |
| 5,759,139 | A * | 6/1998 | Wright | 482/128 |
| 5,971,891 | A * | 10/1999 | Humphrey | 482/51 |
| 7,066,866 | B1 | 6/2006 | Mobley | |
| 7,115,078 | B1 * | 10/2006 | Kalember et al. | 482/117 |
| 8,636,630 | B2 * | 1/2014 | Morris | 482/117 |
| 2003/0013586 | A1 * | 1/2003 | Rothschild | 482/117 |
| 2005/0176558 | A1 | 8/2005 | Huang | |
| 2007/0184941 | A1 | 8/2007 | Krietzman | |
| 2007/0184942 | A1 | 8/2007 | Krietzman | |

* cited by examiner

*Primary Examiner* — Glenn Richman
(74) *Attorney, Agent, or Firm* — Andrus Intellectual Property Law LLP

(57) ABSTRACT

Landmine apparatuses include a mounting base and a receptacle for receiving a weight bar. The receptacle is coupled to the mounting base and rotatable about a horizontal axis and in 360 degrees about a vertical axis. A vertical pivot connects the receptacle to the mounting base such that the receptacle is retained in a single horizontal plane while rotating about the vertical axis.

18 Claims, 4 Drawing Sheets

LANDMINE APPARATUSES

CROSS-REFERENCE TO RELATED APPLICATION

The present disclosure relates to and claims priority of U.S. Provisional Patent Application No. 61/583,086, filed Jan. 4, 2012, the disclosure of which is incorporated herein in entirety.

FIELD AND BACKGROUND

The present disclosure relates to exercise equipment including weight training equipment. The present disclosure arose during continuing development efforts in the field of exercise equipment.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter. In some examples, a landmine apparatus has a mounting base, a receptacle for receiving a weight bar, the receptacle being coupled to the mounting base and being rotatable about a horizontal axis and in 360 degrees about a vertical axis. A vertical pivot connects the receptacle to the mounting base such that the receptacle is retained in a single horizontal plane while rotating about the vertical axis. Some examples provide means for connecting the receptacle to the mounting base such that the weight bar is rotatable about the horizontal axis while being retained in a single vertical plane and rotatable in 360 degrees about the vertical axis while being retained in a single horizontal plane.

BRIEF DESCRIPTION OF THE DRAWINGS

Examples of landmine apparatuses are described with reference to the following drawing figures. The same numbers are used throughout the drawing figures to reference like features and components.

DETAILED DESCRIPTION OF THE DRAWINGS

Figure 2:
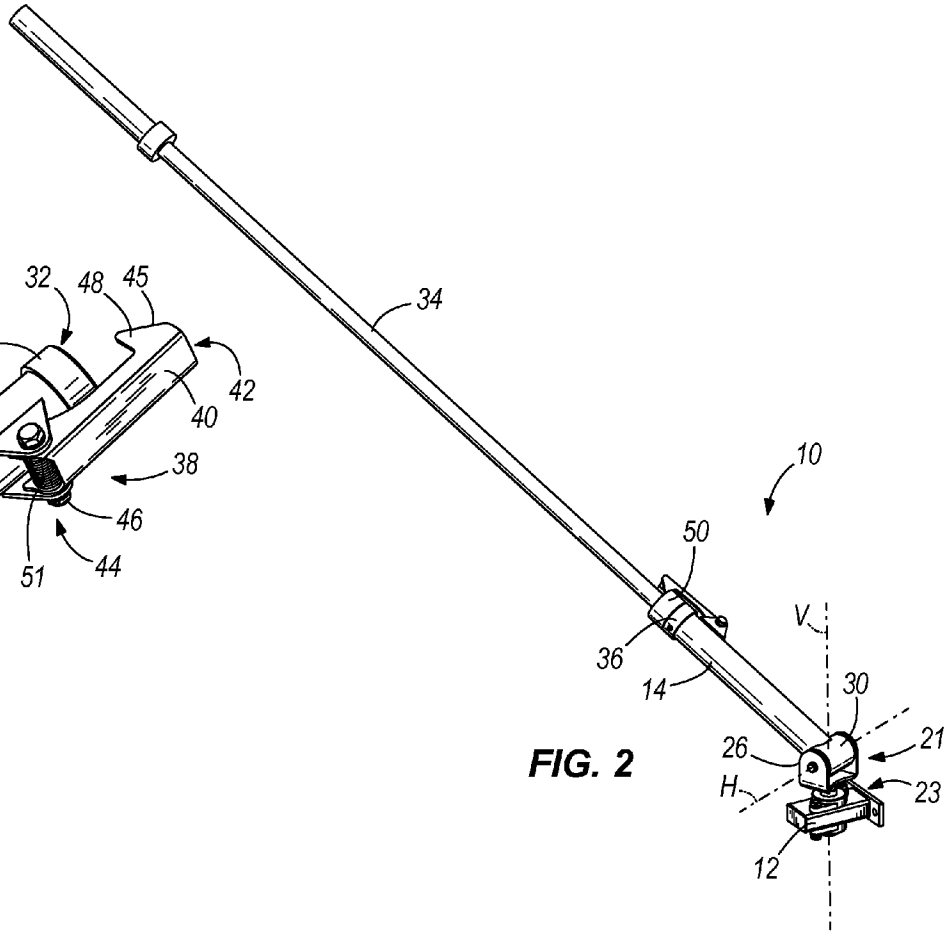
FIG. 2 is a perspective view of the landmine apparatus of FIG. 1 receiving a weight bar.
Figure 1:
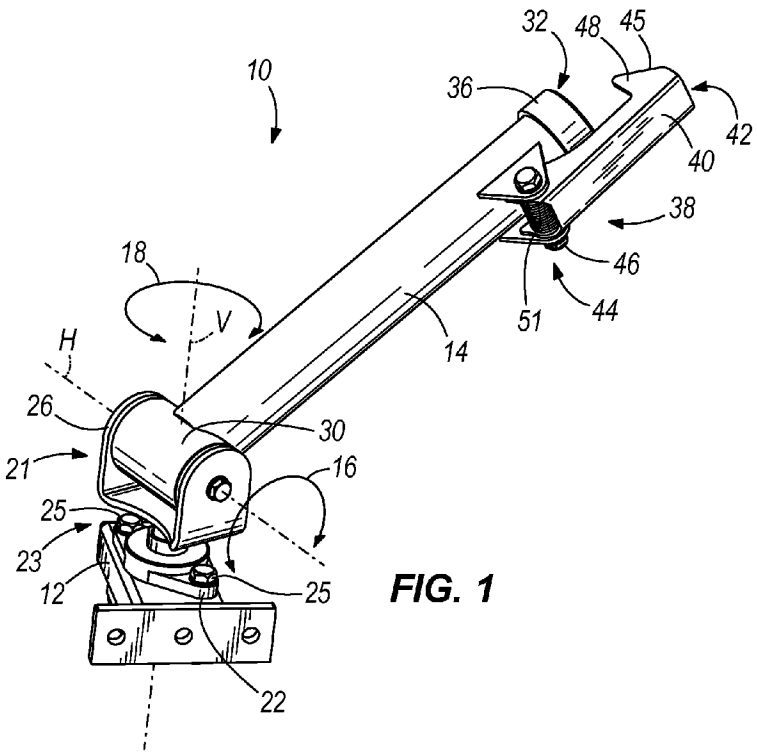
FIG. 1 is a perspective view of a landmine apparatus.
Figure 3:
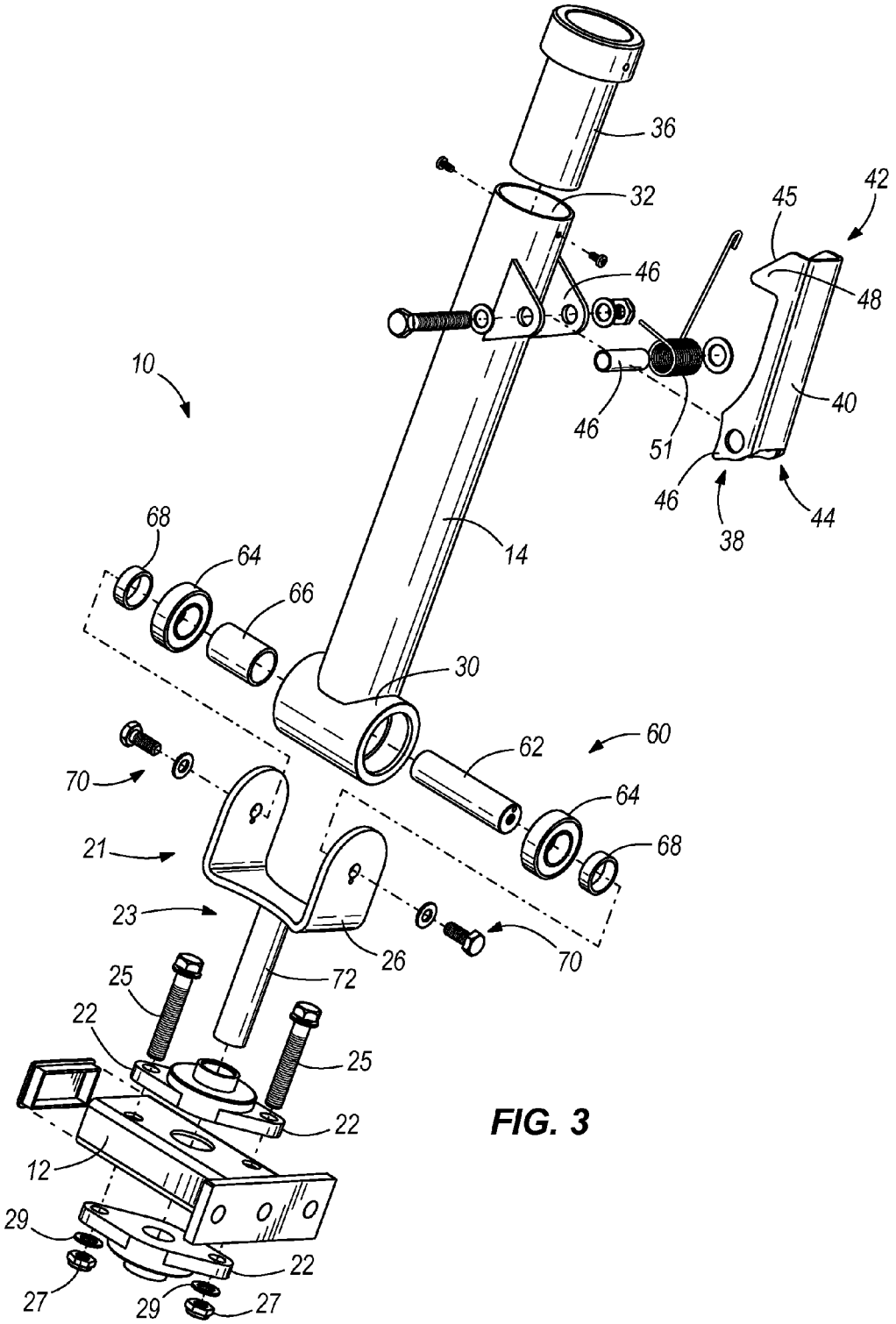
FIG. 3 is an exploded view of the landmine apparatus.
Figure 4:
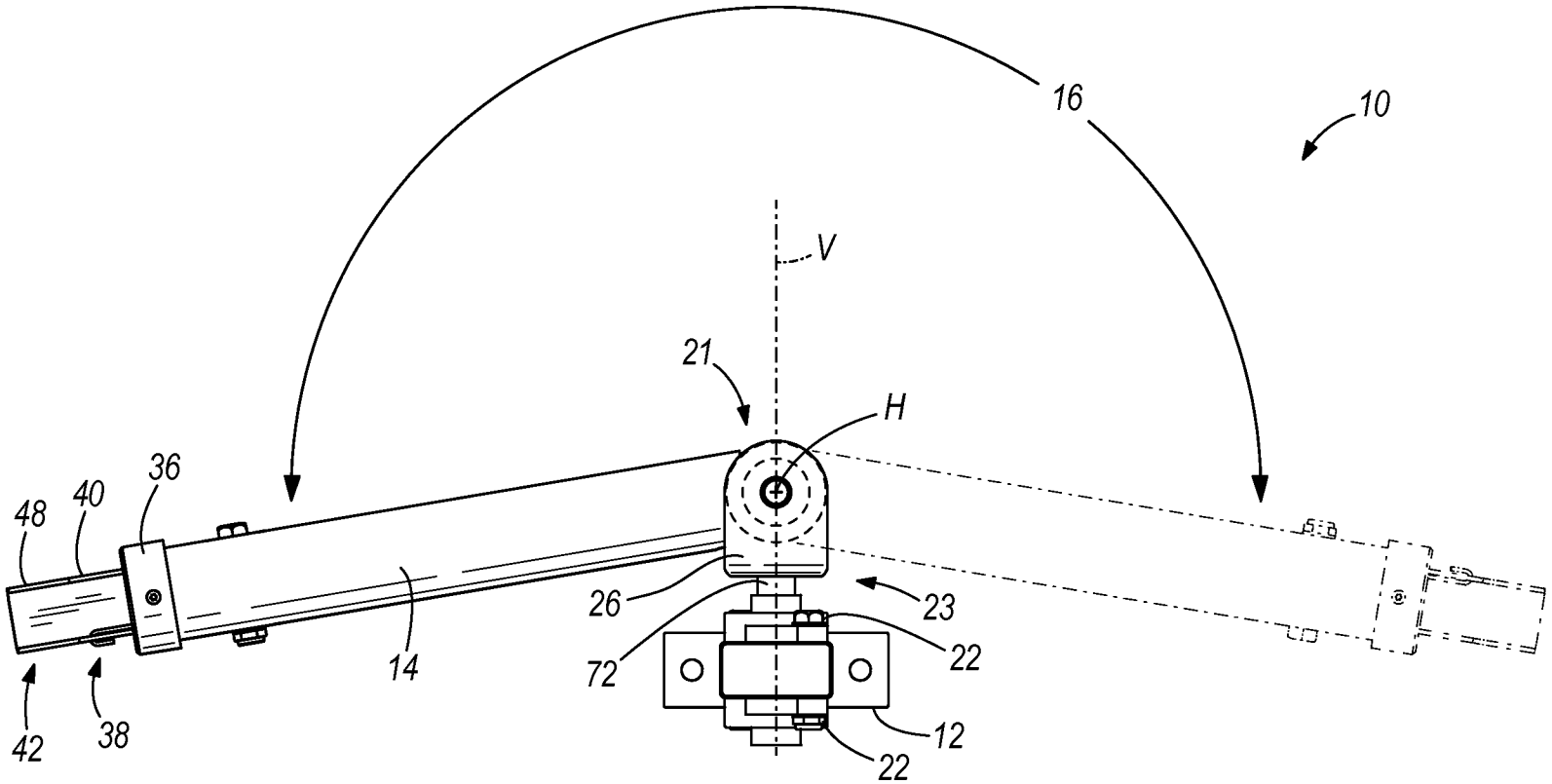
FIG. 4 is a side view of the landmine apparatus.
Figure 5:
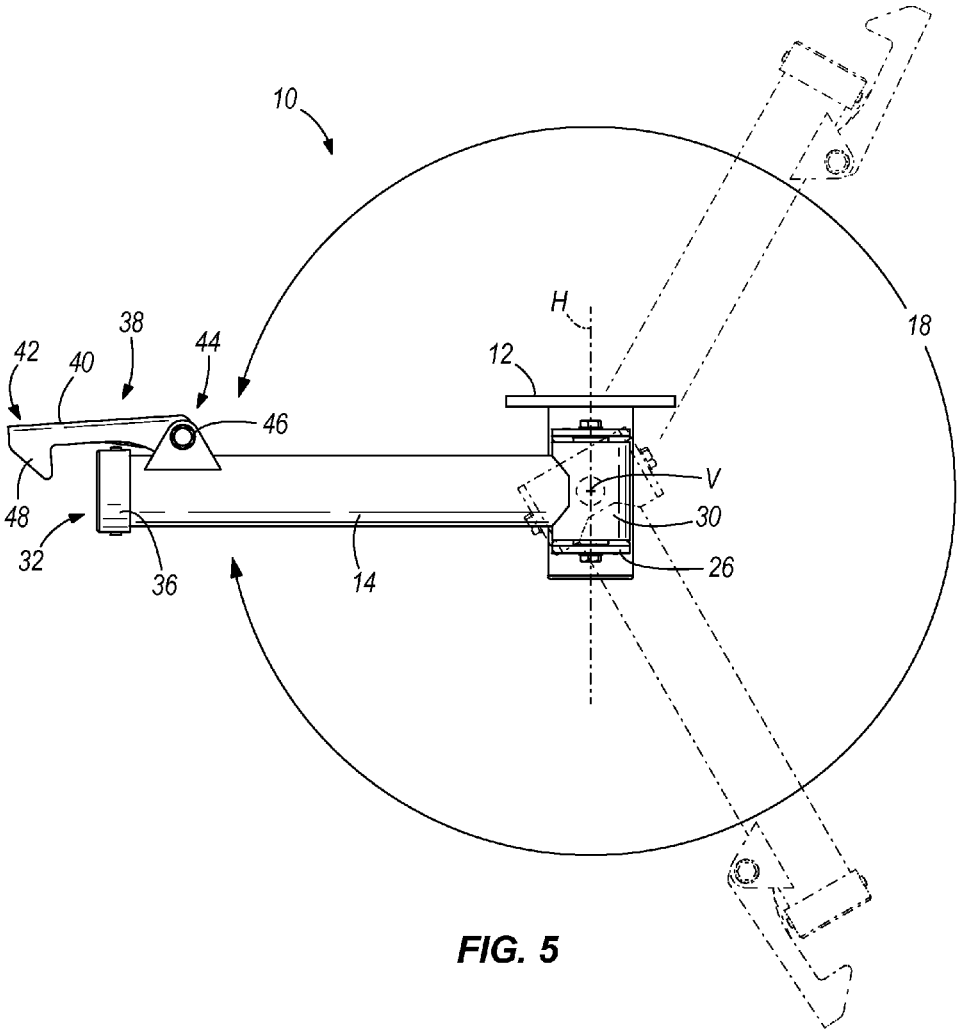
FIG. 5 is a top view of the landmine apparatus.

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

FIGS. 1-5 depict a landmine apparatus 10 for use in the strength equipment and/or functional training equipment fields. The landmine apparatus 10 has a mounting base 12 and a receptacle 14. The receptacle 14 is coupled to the mounting base 12 in a manner such that it is rotatable about a horizontal axis H and is rotatable in 360-degree motion about a vertical axis V. Rotation about the horizontal axis H is shown at arrows 16 in FIGS. 1 and 4. Rotation in 360 degrees about the vertical axis V is shown at arrows 18 in FIGS. 1 and 5.

A horizontal pivot 21 connects the receptacle 14 to the mounting base 12 such that the receptacle 14 is retained in a single vertical plane while rotating about the horizontal axis H. In this example, the receptacle 14 is connected to a bearing tube 30, which in turn is connected to a yolk assembly 26. The bearing tube 30 is rotatable in the yolk assembly 26 in approximately 180-degree motion about the horizontal axis H. A roller bearing 60 (FIG. 3) is disposed in the bearing tube 30. The roller bearing 60 can include a bearing shaft 62 and opposing bearings 64. A spacer 66 is disposed on the outer circumference of bearing shaft 62 for spacing the bearing shaft 62 from the inner surface of the bearing tube 30. Outer spacers 68 are disposed against the bearings 64. Bolt and washer assemblies 70 attach the respective components so that the bearing tube 30 is pivotably attached to the noted yolk assembly 26.

A vertical pivot 23 connects the receptacle 14 to the mounting base 12 such that the receptacle 14 is retained in a single horizontal plane while rotating about the vertical axis V. In this example, a vertical shaft 72 (FIG. 3) extends from the yolk assembly 26 into the mounting base 12 and is rotatable about the vertical axis V through the noted 360-degree motion. The vertical shaft 72 is supported on the mounting base 12 by a pair of flange bearings 22. In other examples, one or more than two flange bearings 22 could be employed. The flange bearings 22 are connected to the mounting base 12 by bolts 25, and nuts 27 with washers 29 therebetween.

The receptacle 14 has a tubular cavity 32 for receiving a weight bar 34 (FIG. 2). A protective insert 36 is disposed on the receptacle 14 to separate the receptacle 14 and the weight bar 34, thus protecting the respective components from damage. In this example, the protective insert 36 is a guide sleeve that is made of plastic. The guide sleeve is inserted in the tubular cavity 32 at the free end of the receptacle 14.

A latch mechanism 38 locks the weight bar 34 in place when it is inserted in the tubular cavity 32 of the receptacle 14. In this example, the latch the mechanism 38 has an arm 40 that is pivotally connected to the receptacle 14. The arm 40 has a first end 44 and a second end 42. The first end 44 is pivotally connected to the receptacle 14 by a bracket and pin connection 46. The second end 42 of the arm 40 has a finger 48 for engaging with the weight bar 34, and specifically with the end flange 50 of the weight bar 34. One or more than one fingers 48 can be employed. A spring 51 biases the arm 40 so that the finger 48 engages the weight bar 34 and retains the weight bar 34 towards engagement in the tubular cavity 32 of the receptacle 14. A cam surface 45 on the second end 42 of the arm 40 is cammed outwardly away from the receptacle 14, against the bias of spring 51 by the end flange 50 of the weight bar 34, when the weight bar 34 is inserted into the receptacle 14. The bias of the spring 51 forces the arm 40 back towards the receptacle 14 once the end flange 50 passes by the cam surface 45.

The present disclosure thus provides a landmine apparatus 10 having a mounting base 12 and a receptacle 14 for receiving a weight bar 34, the apparatus 10 including means for connecting the receptacle 14 to the mounting base 12 so that the weight bar 34 is rotatable about a horizontal axis H and rotatable in 360-degree motion about a vertical axis V. Providing such freedom of rotation of the weight bar 34 allows freedom to the user to be in various positions with respect to the apparatus 10. The vertical and horizontal pivots 23, 21 advantageously provide stability to the apparatus 10 by retaining the receptacle in the noted planes during rotation.

The latch mechanism 38 safely locks the weight bar 34 with respect to the apparatus 10 and the protective insert 36 prevents damage to the respective weight bar 34 and receptacle 14.

Although only a few examples have been described in detail above, those skilled in the art will readily appreciate that many modifications are possible in the examples without materially departing from this invention. Accordingly, all such modifications are intended to be included within the scope of this disclosure as defined in the following claims. In the claims, means plus function clauses are intended to cover the structures described herein as performing the recited function and not only structural equivalents, but also equivalent structures. Thus, although a nail and a screw may not be structural equivalents in that a nail employs a cylindrical surface to secure wooden parts together, and whereas a screw employs a helical surface, in the environment of fastening wooden parts, a nail and a screw may be equivalent structures. It is the express intention of the Applicant not to invoke 35 U.S.C. §112, paragraph 6, for any limitations of any of the claims herein, except for those in which the claim expressly uses the words "means for" together with an associated function.

What is claimed is:

1. A landmine apparatus comprising:

a mounting base;

a receptacle for receiving a weight bar, the receptacle being coupled to the mounting base and being rotatable about a horizontal axis and in 360 degrees about a vertical axis;

a vertical pivot connecting the receptacle to the mounting base such that the receptacle, is retained in a single horizontal plane while rotating about the vertical axis; and a horizontal pivot connecting the receptacle to the mounting base such that the receptacle is retained in a single vertical plane while rotating about the horizontal axis.

2. A landmine apparatus according to claim 1, wherein the vertical pivot extends along the vertical axis.

3. A landmine apparatus according to claim 2, wherein the vertical pivot comprises at least one flange bearing.

4. A landmine apparatus according to claim 3, wherein the vertical pivot comprises a vertical shaft that extends into the base.

5. A landmine apparatus according to claim 1, wherein the horizontal, pivot externs along the horizontal axis.

6. A landmine apparatus according to claim 1, wherein the horizontal pivot comprises a roller bearing.

7. A landmine apparatus according to claim 6, wherein the horizontal pivot comprises a yolk assembly.

8. A landmine apparatus according to claim 7, wherein the receptacle is coupled to a bearing tube, which is connected to the yolk assembly.

9. A landmine apparatus according to claim 8, wherein the bearing tube is supported on the roller bearing.

10. A landmine apparatus according to claim 1, wherein the receptacle is pivotable more than 90 degrees about the horizontal axis.

11. A landmine apparatus according to claim 1, wherein the receptacle has a tubular cavity.

12. A landmine apparatus according to claim 11, comprising a protective insert disposed on the receptacle to separate the receptacle from the weight bar.

13. A landmine apparatus according to claim 12, wherein the protective insert comprises a guide sleeve.

14. A landmine apparatus according to claim 13, wherein the guide sleeve is made of plastic.

15. A landmine apparatus according to claim 11, comprising a latch mechanism that locks the weight bar in place when it is inserted in the receptacle.

16. A landmine apparatus according to claim 15, wherein the latch mechanism comprises an arm that is pivotably connected to the receptacle.

17. A landmine apparatus comprising:

a mourning base;

a receptacle for receiving a weight bar, the receptacle being coupled to the mounting base and being rotatable about a horizontal axis and in 360 degrees about a vertical axis; and a vertical pivot connecting the receptacle to the mourning base such that the receptacle is retained in a single horizontal lane while rotating about the vertical axis;

wherein the receptacle has a tubular cavity;

a latch mechanism that locks the weight bar in place when it is inserted in the receptacle;

wherein the latch mechanism comprises an arm that is pivotably connected to the receptacle; and wherein the arm has a first end a second end, the first end being pivotably connected to the receptacle and the second end having a finger for engaging the weight bar.

18. A landmine apparatus according to claim 17, comprising a spring biasing the arm so that the finger engages the weight bar.

* * * * *

UNITED STATES PATENT AND TRADEMARK OFFICE

CERTIFICATE OF CORRECTION

PATENT NO. : 8,974,354 B1
APPLICATION NO. : 13/427569
DATED : March 10, 2015
INVENTOR(S) : Westin Nelson and Dennis Whaley It is certified that error appears in the above-identified patent and that said Letters Patent is hereby corrected as shown below:

In the Claims,

In claim 1, column 3, line 31: delete the "," between "receptacle" and "is".

In claim 5, column 3, line 45: "externs" should instead read "extend".

In claim 17, column 4, line 27: "mourning" should instead read "mounting".

In claim 17, column 4, line 33: "mounrning" should instead read "mounting".

In claim 17, column 4, line 41: add the word "and" between "end" and "a" to read "a first end and a second end,".

Signed and Sealed this
Sixteenth Day of June, 2015

Michelle K. Lee

Michelle K. Lee
*Director of the United States Patent and Trademark Office*